US005604953A

United States Patent [19]

Castwall et al.

[11] Patent Number: 5,604,953

[45] Date of Patent: Feb. 25, 1997

[54] VACUUM CLEANER

[75] Inventors: Lennart W. Castwall, Täby; Magnus C. W. Lindmark, Stockholm; Lars G. Moren, Huddinge, all of Sweden

[73] Assignee: Aktiebolaget Electrolux, Stockholm, Sweden

[21] Appl. No.: 507,465

[22] PCT Filed: Jan. 3, 1994

[86] PCT No.: PCT/SE94/00003

§ 371 Date: Aug. 23, 1995

§ 102(e) Date: Aug. 23, 1995

[87] PCT Pub. No.: WO94/15518

PCT Pub. Date: Jul. 21, 1994

[30] Foreign Application Priority Data

Jan. 8, 1993 [SE] Sweden ..... 9300032

[51] Int. Cl.[6] ..... A47L 9/26; A47L 5/24

[52] U.S. Cl. ..... 15/323; 15/344

[58] Field of Search ..... 15/319, 323, 327.1, 15/327.2, 329, 344, 412

[56] References Cited

U.S. PATENT DOCUMENTS

| | | | |
|---|---|---|---|
| 2,052,341 | 8/1936 | Douglass | 15/323 |
| 2,699,838 | 1/1955 | Holm-Hansen | 15/327.1 |
| 2,825,086 | 4/1958 | Tamarin | 15/323 |
| 2,862,220 | 12/1958 | Orr | 15/323 |
| 4,421,964 | 12/1983 | Buchtel | 15/344 |
| 4,467,493 | 8/1984 | Buchtel | 15/323 |
| 4,610,048 | 9/1986 | Ishihara et al. | 15/344 |
| 4,654,926 | 4/1987 | McCambridge | 15/353 |

FOREIGN PATENT DOCUMENTS

| | | | |
|---|---|---|---|
| 2153226 | 5/1973 | Germany | 15/323 |

*Primary Examiner*—Tony G. Soohoo

*Attorney, Agent, or Firm*—Pearne, Gordon, McCoy & Granger

[57] ABSTRACT

Vacuum cleaner including a unit, comprising an electric motor and an associated suction fan, and a suction nozzle (36) connected to the inlet side of the unit via a dust separating device (15), either directly or via a connectable rigid conduit (13). The vacuum cleaner comprises a handheld unit (10) which when not in use is arranged to be positioned on a stationary storage unit (11), said handheld unit (10) incorporating the said unit and the dust separating device (15) and being provided with a coupling means (12) for connecting of the rigid conduit (13). For power supply purposes, by means of an extensible flex (26), the handheld unit (10) is connected to the storage unit (11) which via an additional flex (39) is connectable to a mains outlet.

5 Claims, 4 Drawing Sheets

VACUUM CLEANER

BACKGROUND OF THE INVENTION

The present invention relates to a vacuum cleaner including a unit comprising an electric motor and an associated suction fan, a rigid conduit connectable to the inlet side of the unit via a dust separating device and a suction nozzle connectable to the opposite side of the conduit.

Vacuum cleaners according to the above general definition exist in various designs. A common type is the canister cleaner having the shape of a larger loaf and comprising a suction fan driven by an electric motor. The vacuum cleaner has an inlet opening connected to a suction nozzle via a hose and a so-called extension tube. Air is conducted from the suction nozzle, via the extension tube and the hose into the vacuum cleaner in which it passes through a filter in the shape of a dust container where the dust particles conveyed by the air are separated. Then, the air passes the suction fan and is also led past the motor for the purpose of cooling the same before being let out to the ambient atmosphere, usually after having passed through an additional filter which acts also as a diffusor. When the vacuum cleaner is to be used, a person grips a handle disposed at the end of the hose turned away from the vacuum cleaner and connecting the hose with the extension tube. In this way the user can move the suction nozzle across the underlying surface and if needed the vacuum cleaner, which is provided with wheels, can be moved across the underlying surface by the user pulling the hose.

Another kind of vacuum cleaner is the so-called upright cleaner which comprises a floor unit and a handle part. The floor unit comprises a suction nozzle and, in addition, a rotating brush having a beating effect on soft surfaces, like wall-to-wall carpets. The handle part comprises a larger dust container and also serves as an operating means for controlling the movement of the floor unit across the surface to be cleaned.

The two types of vacuum cleaners referred to above both have considerable weight, of the order of 5–10 kg, and are cumbersome in use due to weight. A particularly difficult situation is when the vacuum cleaner is to be taken out from or put into a storage cabinet or, for example in a multi-level structure, when it is to be moved between two different floors.

On the market there is also a type of vacuum cleaner which to some extent remedies the disadvantage caused by weight. This type of vacuum cleaner, often referred to as a stick vacuum cleaner, is of the same category as the upright cleaner however, the floor unit comprises a suction nozzle only (i.e., without any rotating brush) and the vacuum cleaner is smaller and also less heavy than the normal upright cleaner. A disadvantage is that for weight reasons the vacuum cleaner is equipped with a smaller motor fan unit causing the vacuum cleaner to be less efficient as compared to the corresponding canister cleaner or upright cleaner.

SUMMARY OF THE INVENTION

Based on the stick vacuum cleaner, referred to, it is an object of the invention is to make this cleaner as efficient as a corresponding vacuum cleaner of the canister type or the upright type and at the same time to reduce the weight even further. In order for this to be achieved it is necessary to focus onto the heaviest unit in the vacuum cleaner, namely the motor fan unit and then, in the first place, the motor.

From turbo units in automobiles it is known that by use of rapidly rotating impellers, small in size, it is possible to introduce under pressure large amounts of air into the intake system of an automotive engine. In this case a high pressure is created by means of the impeller but, of course, a suction force can be created correspondingly. This idea is the basis for the invention, namely that by means of a rapidly rotating impeller, small in size, it would be possible to create a suction effect of the same magnitude as in the vacuum cleaners of the canister or the upright type, respectively, referred to above, however, with reduced dimensions of the suction fan. In this case the impeller is not driven by exhaust gases as in the automobile case but by an electric motor which has to operate at a speed considerably exceeding the speed up to now commonly used in vacuum cleaner motors. With the type of load used the high speed makes it possible to obtain the same power as in a vacuum cleaner of the common type but with reduced dimensions of the motor. The part of the invention relating to the design of a hand-hold unit in the shape of a stick vacuum cleaner as concerns the type of suction fan and the drive motor for same is the subject matter of Swedish Patent Application No. 9300033-9 having the same filing date as the present application.

In the present application the object is to further develop the concept of a hand-held vacuum cleaning unit such that as few parts as possible are included in the unit and other parts required which are space-consuming and heavy be collected in another unit which can be placed stationary on the floor adjacent to a wall outlet and which can serve as a storage unit for the hand-held vacuum cleaning unit. Within the definition "stationary" there is included also the meaning that the placement is stationary during vacuuming but that the unit is movable to make possible the storage in a closet or the like.

BRIEF DESCRIPTION OF THE DRAWINGS

The invention will now be described in more detail in connection with an embodiment with reference to the enclosed drawings, in which.

DETAILED DESCRIPTION OF THE PREFERRED EMBODIMENT

The vacuum cleaner according to the invention comprises a hand-held vacuum cleaning unit 10 and a storage unit 11 for the storage of same. The vacuum cleaning unit 10 comprises a suction fan and an electric motor for driving the fan, said fan and motor forming a motor-fan unit. The design of said parts are discussed in detail in the parallel application referred to above and they will not be described nor shown in detail in this context.

Figure 1:
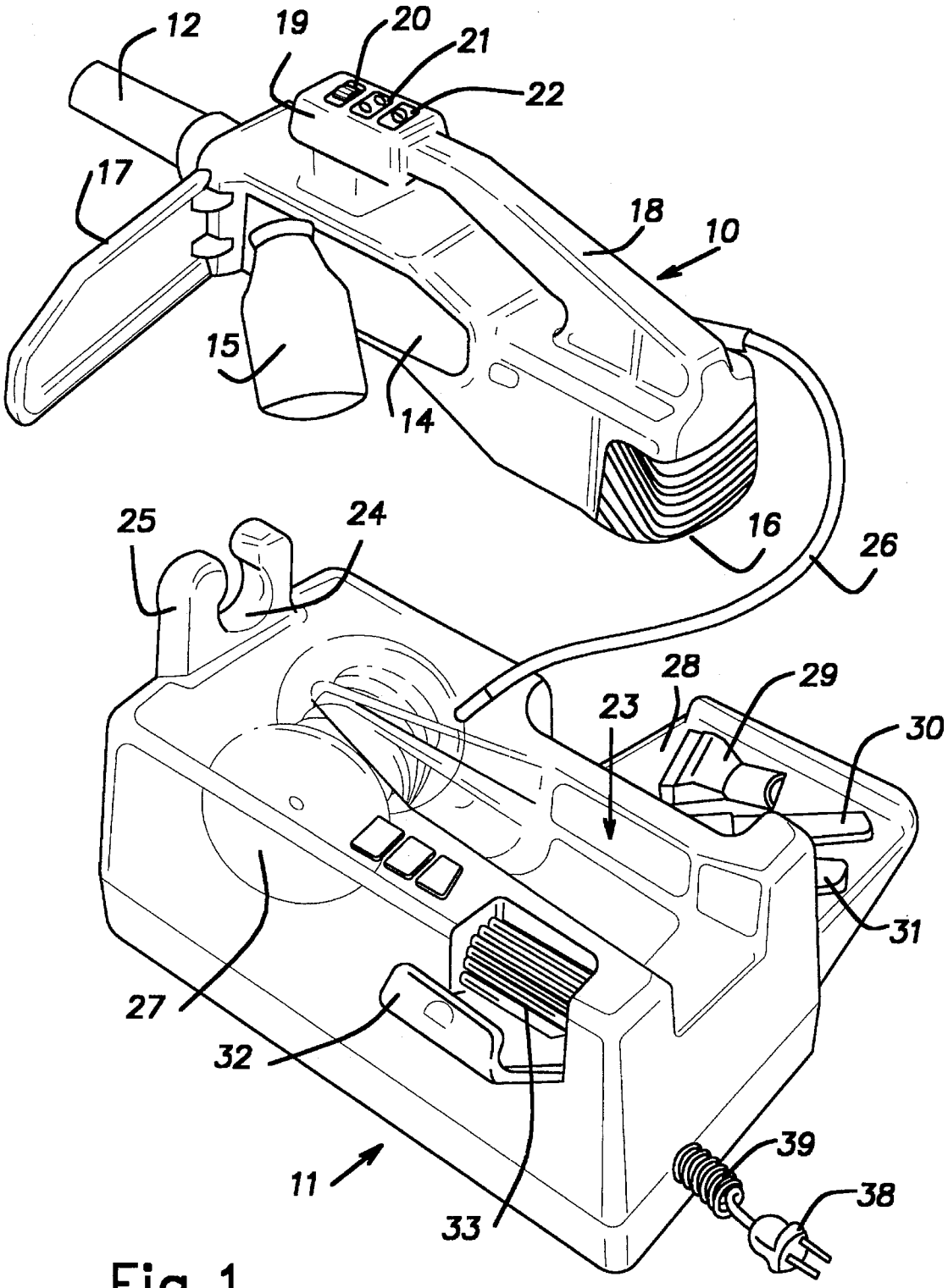
FIG. 1 shows a perspective view of a vacuum cleaner according to the invention comprising a hand-held vacuum cleaning unit and a stationary storage unit for said hand-held unit.
Figure 2:
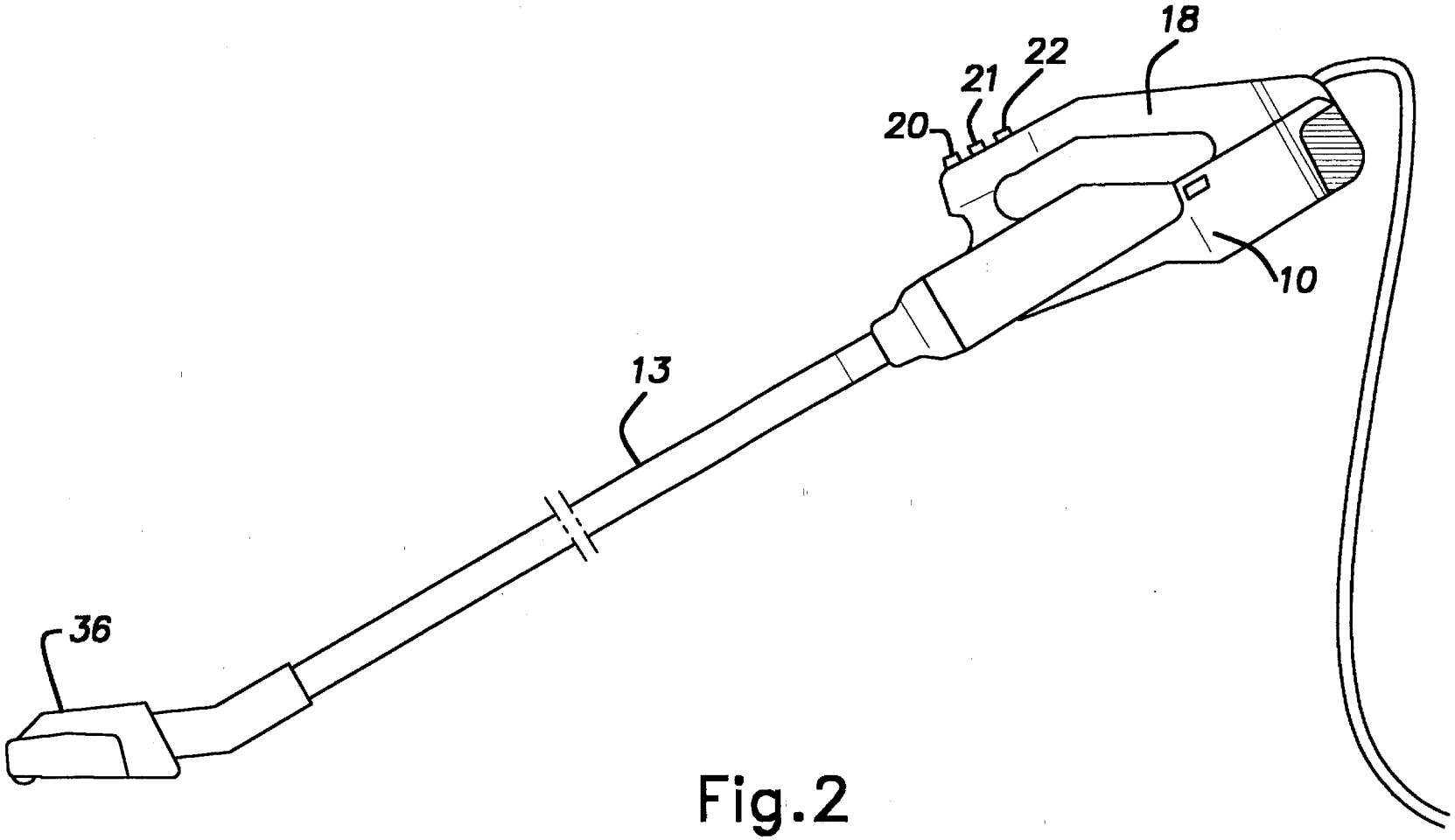
FIG. 2 shows the hand-held vacuum cleaning unit ready for use.

The air passage through the unit 10 includes a coupling part 12 for the connection of a rigid tube 13, often referred to as an extension tube (FIG. 2). Moreover, a cavity 14 is included in which a dust container 15 is being disposed. The intake channel of the suction fan, not shown, opens into the cavity 14 and the air is discharged via an exhaust opening marked by 16 in FIG. 1. As known, the exhaust opening can be covered by an. additional filter, not shown, referred to as a diffusor filter and operating to further purify the exhaust air.

On its side, the vacuum cleaning unit 10 is provided with a door 17 that can be turned outwards and which is connected with the dust container such that the latter is turned outwards when the door is opened, facilitating the replacement of the dust container. On its upper side the vacuum cleaning unit is provided with a handle 18, at the front end of which there is provided an operating panel 19. The panel comprises push-buttons and like operating means 20, 21, 22 by means of which the operation of the vacuum cleaner can be controlled.

In order to relieve the vacuum cleaning unit 10 of excessive weight certain parts which are important for the operation of the unit have been transferred to the storage unit 11 which is disposed on the floor. The storage unit has a recess 23 in which the vacuum cleaning unit 10 can be inserted and locked. This may take place, for example, by the vacuum cleaning unit, before being inserted into the recess 23 in which to cooperate with some kind of locking means, being moved in such a way that the coupling part 12 enters an opening 24 in a fastening member 25 on the storage unit. A catch means, not shown, operates to retain the vacuum cleaning unit in its locked position and the vacuum cleaning unit can be detached after the release of the catch means by operating of a push-button 47. The locking means, the catch means and parts transmitting movement from the push-button 47 can be designed in different ways and the design is of no crucial importance in respect of the invention.

The vacuum cleaning unit 10 is electrically connected to the storage unit 11 by a cord or cable 26 which is stored on a cord winder 27, faintly outlined in the figure, when the vacuum cleaner is not in operation. When the vacuum cleaning unit is to be used the cord or cable 26 is pulled out to the desired length where it is automatically blocked against return to the cord winder. After the vacuum cleaning has been completed a catch member can be released so that by means of spring force, or in some other way, the cord can be rewound onto the flex winder. Devices of the kind referred to are of frequent occurrence and will be described only briefly below.

Figure 3:
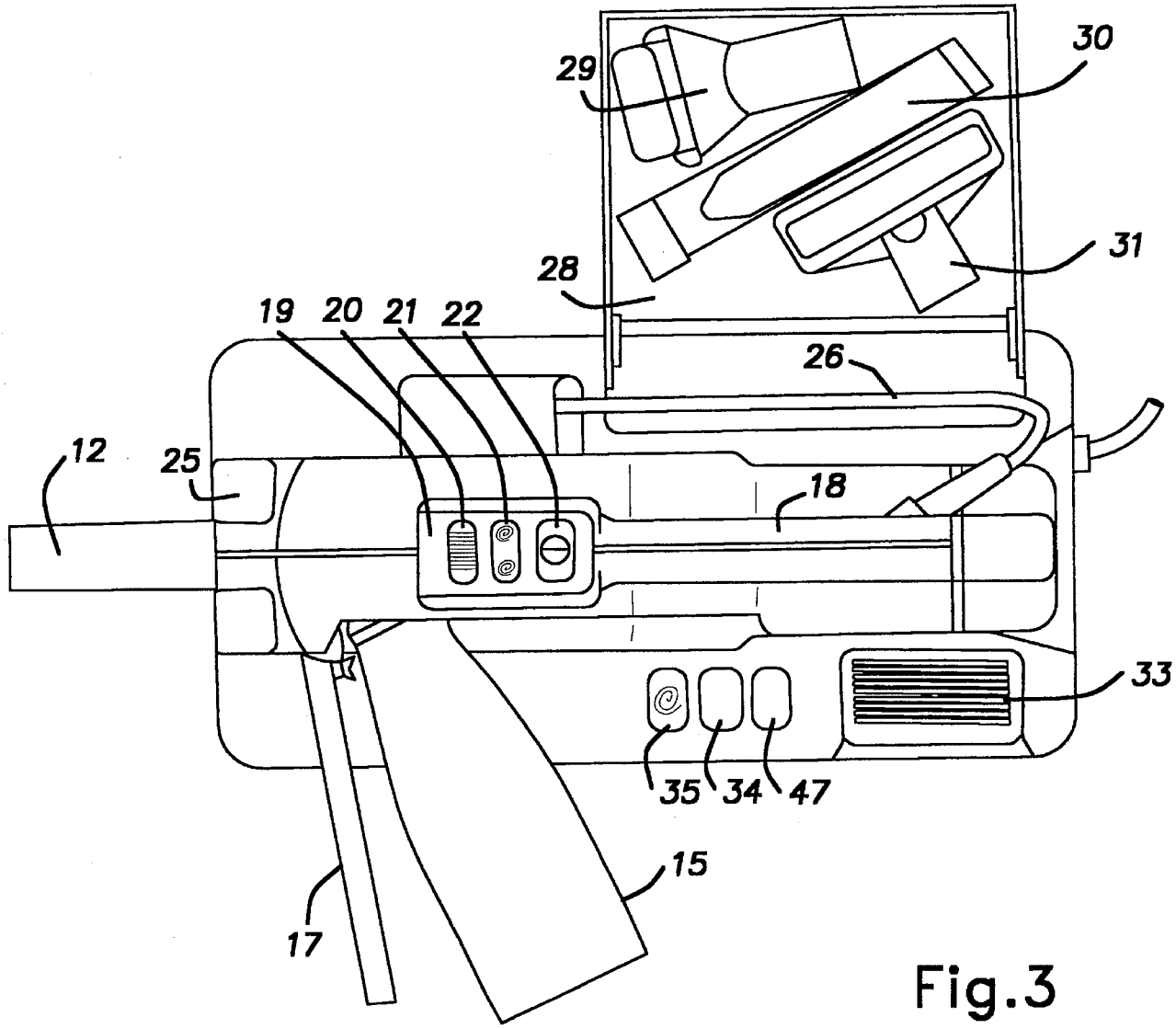
FIG. 3 shows, in a top view, the hand-held unit placed on the storage unit.

In the storage unit 11 a door 28 is provided on which various vacuum cleaning implements 29, 30, 31 can be stored. Inside an additional door 32 there is a space for storage of additional dust containers 33. The door 28 can be opened by operation of a corresponding push-button 34. As also seen in FIG. 3, an additional push-button 35 is provided for the operation of the cord winder when the cord 26 is to be rewound. The constructive solution of the operation of the door 28 by the corresponding push-button 34 can be performed in many different ways and the invention offers no detailed teaching in this respect.

In FIG. 2 the vacuum cleaning unit 10 is shown with the extension tube 13 being attached and with a vacuum cleaning nozzle 36 of any suitable type being connected to the lower end of said extension tube. Here, the vacuum cleaning unit is ready for use.

The electric motor included in the unit 10 is intended for operation at high speeed, in the range from 60,000 rpm and upwards. By the high speed and by the use of a suction fan designed with a turbine wheel the dimensions and weight can be drastically reduced at the same time as the vacuum cleaner is given the performance of a normal vacuum cleaner having an input power in the range up to 1500 W. The series motor, the common motor type in a vacuum cleaner, cannot be used anymore at these high speeds and the choice points at a brushless electronically controlled motor of the DC-type or the induction type. The choice of motor and the choice of the control electronics are discussed in the parallel application referred to and will not be described in detail in this context. However, the disposition of the electronics is of interest and here the electronic components are provided on a circuit board 37 which is disposed in the storage unit 11. Supply voltage is applied to the electronics from a common mains outlet via a plug 38 and a cord or cable 39 and said supply voltage is converted by the electronics into suitable control signals and power pulses which are being lead by the cord 26 to the motor, not shown, for driving same. The control buttons 20, 21, 22 are provided for the control of the function of the vacuum cleaner, such as start/stop, outflow and rewinding of the cord, and control of suction power. To this end, for certain functions the push-buttons are connected to the electronics in the storage unit via a separate lead-integrated with the flex 26.

Figure 5:
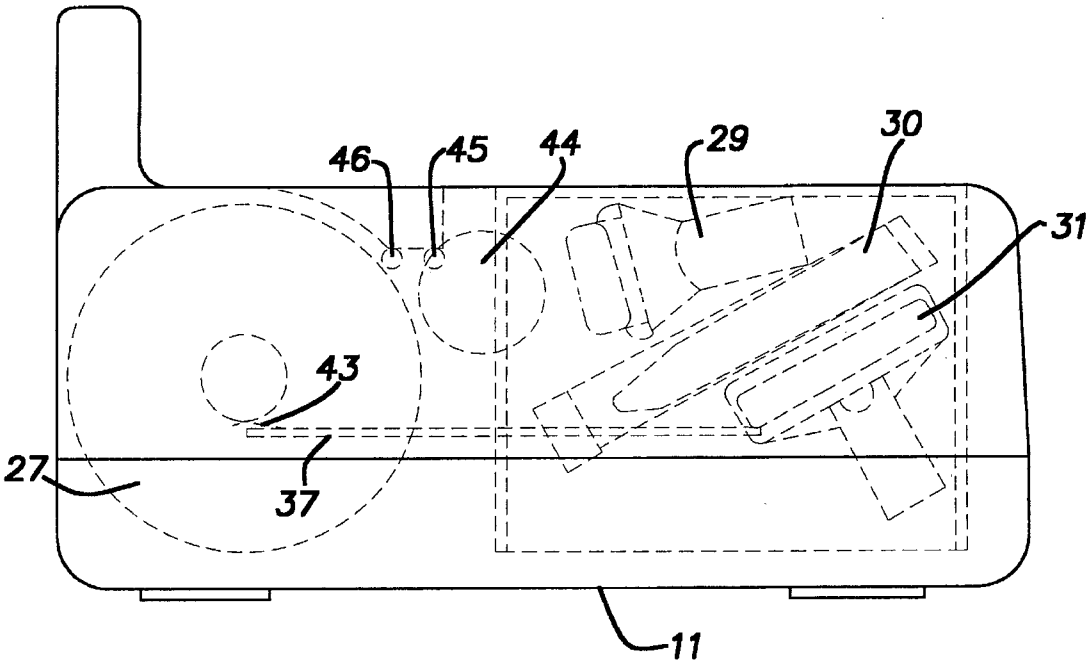
FIG. 5 shows the storage unit in a side view.
Figure 4:
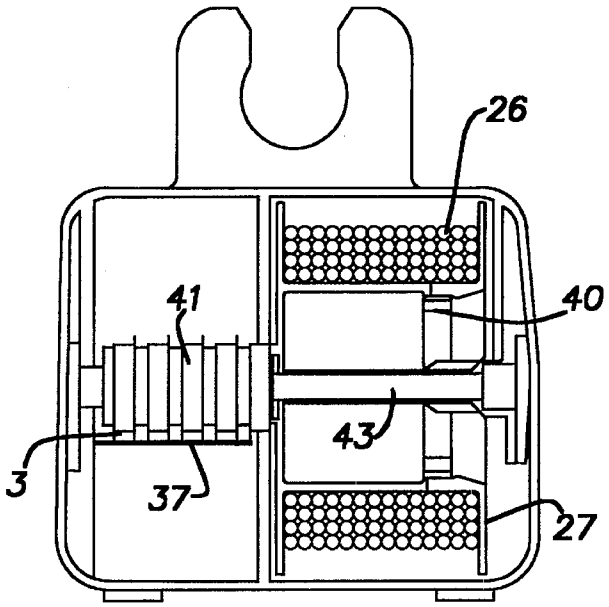
FIG. 4 is a cross-sectional view of the storage unit, showing, in particular, a flex winder disposed in said unit.

FIG. 4 shows a cross-section of the storage unit 11 and, in particular, there is shown the cord winder with the rewound cord 26, a spring 40 supplying the rewinding power and slip rings 41 disposed on a journalling shaft 42 for the cord winder. The slip rings cooperate with contacts 43 provided on the circuit board to electrically connect said board with the electric motor and the operating means in the vaccum cleaning unit 10. As an alternative to the spring driving arrangement the cord winder can be provided with a small electric motor 44 (FIG. 5) which, via drive rolls 45, 46, suitably arranged, pays-out or dispenses the cord or rewinds same onto the cord winder. This outputting and rewinding, respectively, can be controlled by means of the operating button 21, shown in FIGS. 1 and 3. The parts 44–46 are faintly outlined only and they can be constructed in various ways within the scope of the invention.

As shown in FIG. 2, in comparison with a traditional floor-supported vacuum cleaner with attached hose, extension tube and vacuum cleaning nozzle the hand-hold unit is somewhat larger than the handle part of the traditional vacuum cleaner and also slightly heavier because of the suction fan and the motor contained in the hand-hold vacuum cleaning unit. However, said unit is easy to move around by the user as the weight of the unit is partly carried by the underlying surface via the extension tube and the vacuum cleaning nozzle. There is no floor unit which has to be dragged along the floor during vacuuming and in addition, the hose has been eliminated. In removing crumbs or scraps from tables and the like and in vacuum cleaning inside of vehicles the extension tube can be detached and replaced by a suitable smaller nozzle which can be directly connected to the coupling part 12. In this case the vacuum cleaning unit has a size essentially the same as of a battery-operated, so-called car vacuum cleaner and has mainly the same weight making it easy to use at the same time as the performance of the cleaner is at the same level as that of a traditional floor-supported vacuum cleaner.

We claim:

1. Vacuum cleaner system including a hand-held vacuum cleaning unit and a storage unit, said hand-held unit being arranged, when not in use, to be positioned on said storage unit, said hand-held unit comprising an electric motor and an associated suction fan, and having an inlet opening and an outlet opening for an air stream from which dust particles are to be removed, said particles being collected by a dust separating device incorporated in the hand-held unit, coupling means being provided at the inlet opening to fluidly connect said inlet opening with a suction nozzle, said hand-held unit being electrically connected to said storage unit by means of an extensible cord, and an additional cord, connecting said storage unit to a mains outlet, said extensible cord permitting said hand-held unit to be removed from said storage unit and operated at a position remote from said storage unit.

2. Vacuum cleaner system according to claim 1, wherein the motor is operated at a speed such that a speed of the suction fan exceeds 60,000 rpm.

3. Vacuum cleaner system according to claim 1 or claim 2, wherein the storage unit (11) comprises an electronic unit (37) for controlling operation of the electric motor, the electronic unit being connected to the electric motor in the hand-held unit (10) by the extensible cord (26).

4. Vacuum cleaner system according to claim 3, wherein the hand-held unit comprises operating means for controlling operation of the vacuum cleaner.

5. Vacuum cleaner system according to claim 4, wherein the hand-held unit operating means is connected to the electronic unit by a lead provided by the extensible cord.

* * * * *